US010882722B2

(12) United States Patent
Tremblay

(10) Patent No.: US 10,882,722 B2
(45) Date of Patent: Jan. 5, 2021

(54) TOOL FOR LIFTING OPEN FLOOR GRATING AND THE LIKE

(71) Applicant: Steeve Tremblay, St-Charles-de-Bourget (CA)

(72) Inventor: Steeve Tremblay, St-Charles-de-Bourget (CA)

( * ) Notice: Subject to any disclaimer, the term of this patent is extended or adjusted under 35 U.S.C. 154(b) by 231 days.

(21) Appl. No.: 16/136,254

(22) Filed: Sep. 20, 2018

(65) Prior Publication Data

US 2019/0127185 A1 May 2, 2019

(30) Foreign Application Priority Data

Oct. 30, 2017 (GB) ..... 1717873.2

(51) Int. Cl.
*B66C 1/00* (2006.01)
*B66C 1/66* (2006.01)
*B66C 1/62* (2006.01)

(52) U.S. Cl.
CPC . *B66C 1/66* (2013.01); *B66C 1/62* (2013.01)

(58) Field of Classification Search
CPC . B66F 11/00; B66F 19/00; B66C 1/22; B66C 1/62; B66C 1/66
See application file for complete search history.

(56) References Cited

U.S. PATENT DOCUMENTS

| | | | | |
|---|---|---|---|---|
| 3,198,362 | A | 8/1965 | Berg | |
| 3,957,247 | A | 5/1976 | Haller et al. | |
| 4,297,963 | A * | 11/1981 | Beacom | E02B 3/24 114/218 |
| 4,488,706 | A | 12/1984 | Kono | |
| 4,662,607 | A | 5/1987 | Mochizumi et al. | |
| 4,695,037 | A * | 9/1987 | Hadbavny | B66F 19/005 254/131 |
| 4,862,388 | A | 5/1989 | Golding | |
| 4,852,855 | A | 8/1989 | Moisan | |
| 4,904,105 | A * | 2/1990 | Myers | E04C 2/428 403/24 |
| 5,137,314 | A | 8/1992 | Gunter | |
| 5,292,107 | A | 3/1994 | Chick | |
| 2013/0099516 | A1 * | 4/2013 | Parker | B66C 1/66 294/82.23 |

* cited by examiner

*Primary Examiner* — Blake A Tankersley

(57) ABSTRACT

A tool for lifting open floor gratings and the like provides a solid anchor point on top surface of floor grating to facilitate handling and hoisting the grating. The tool includes a body member having an upwardly biased shaft with a push member with an opening on its upper end and a butterfly hook at its bottom end. During operation, a user pushes down on the push member until it is completely inside the body so that the butterfly hook reaches under the grating. The user then gives a quarter turn to the body member so that the butterfly hook turns and thus becomes wider than the cell of the grating so that it can hook up with two bearing bars as the user releases the push member and the shaft springs back up and the opening gets out of the body. Once this is done, a shackle is installed through the opening, and a steel cable placed therein, ready for lifting and hoisting.

8 Claims, 4 Drawing Sheets

18
20
24

19
16
32
22
20
12

TOOL FOR LIFTING OPEN FLOOR GRATING AND THE LIKE

CROSS-REFERENCE TO RELATED APPLICATIONS

The present application claims priority to United Kingdom Patent Application serial number 1717873.2, filed on Oct. 30, 2017, the disclosure of which is hereby incorporated in its entirety at least by reference.

BACKGROUND OF THE INVENTION

1. Field of the Invention

The present invention generally relates to hand tools but more particularly to a lifting clamp for lifting open floor gratings and the like.

2. Description of Related Art

The standard size of a floor grating whether steel or fiberglass reinforced resin is 3 feet by 24 feet, for a weight of approximately 500 pounds or less for fiberglass reinforced resin. Due to their size and weight, there is great difficulty moving floor gratings. Further, there is a lack of specialized tools for the handling or the lifting of a floor grating. Currently, known methods for handling or lifting floor gratings teach rigging slings to the outside of the floor grating perimeter. This method prevents from placing the floor grating directly at its final location, since the grating is always enclosed within other structural elements. The rigger must therefore place it as close as possible to the required location on the structure where it will be possible to remove the slings and then manually finish the installation at its final location. This method greatly increases the risk of injury and makes it very difficult to install the floor grating.

BRIEF SUMMARY OF THE INVENTION

In one embodiment of the present invention a tool for lifting a floor grating comprising: a body member having a top surface and a bottom surface; the slot extends downwardly generally halfway into the body member, and a second slot is located at the bottom surface configured for receiving a butterfly hook mechanically attached to a bottom portion of the shaft by way of mechanical fasteners; the push member has an opening at a top end which extends integrally from an upper portion of a shaft, and a butterfly hook mechanically attached at a bottom portion of the shaft by way of mechanical fasteners; a biasing member configured to upwardly bias the push member to an upper position; and, wherein the tool is configured to be positioned on the top surface of the floor grating, the butterfly hook is inserted between two bearing bars, wherein the push member is configured to be pushed with a downward force overcoming the upwardly bias such that the butterfly hook extends below the floor grating, and the opening of the push member slides inside the body and wherein the tool is configured to be rotated a quarter turn such that the butterfly hook may not pass through the bearing bars of the floor grating, and releasing the downward force such that the push member is forced back to the upper position such that the butterfly hook makes contact with the bottom surface and partially surrounds the bearing bars so as to hook onto the floor grating, simultaneously, the opening of the push member comes back out of the body.

In one embodiment, a pair of cambered handle members attached to the body member for ease of transportation and installation is provided. In one embodiment, a shackle is configured to be installed through the opening of the push member such that a steel cable may be attached to the shackle for hoisting the floor grating. In one embodiment, the body member is constructed to form a pyramid shape. In another embodiment, the pyramid shape has parallel bottom and top flat surfaces. In yet another embodiment, the shaft is perforated.

In another aspect of the invention, a method is provided for lifting a floor grating comprising steps: (a) providing a tool, the tool comprising a body member having a top surface, a bottom surface, a first slot extending generally halfway down from the top surface and a second slot at the bottom surface, the slot configured to receive a push member, wherein the push member has an opening at a top end, a butterfly hook mechanically attached at a bottom end of the shaft by mechanical fasteners, and a biasing member configured to upwardly bias the push member to an upper position; (b) placing the tool on the floor grating in a first position defined as the butterfly hook is inserted between two bearing bars of the floor grating; (c) applying a downward force to the push member overcoming the upwardly bias such that the butterfly hook extends below the floor grating and bearing bars and the opening slides inside the body; (d) rotating the tool a quarter turn such that the butterfly hook may not pass through two bearing bars of the floor grating; (e) releasing the downward force such that the push member is forced back to the upper position, the opening of the push member comes back out the body and the butterfly hook reaches the bottom surface and partially surrounds two bearing bars on the bearing bars of the floor grating; (f) installing a shackle pin through the opening; and, (g) placing a steel cable through the shackle such that the tool may be hoisted with the attached floor grating via the steel cable.

In one embodiment, a further step is provided wherein the steel cable and attached floor grating is lifted via a crane.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a tool for lifting open floor gratings and the like.

Figure 1B:
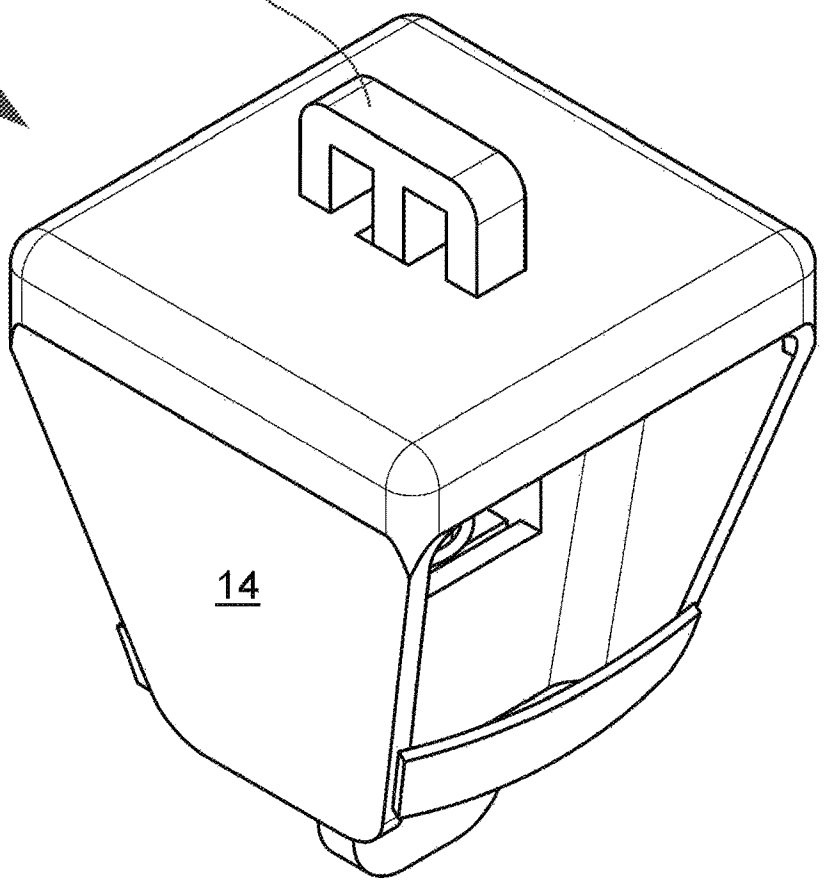
FIGS. 1A-B are isometric views of a tool for lifting open floor gratings according to an embodiment of the present invention.
Figure 1A:
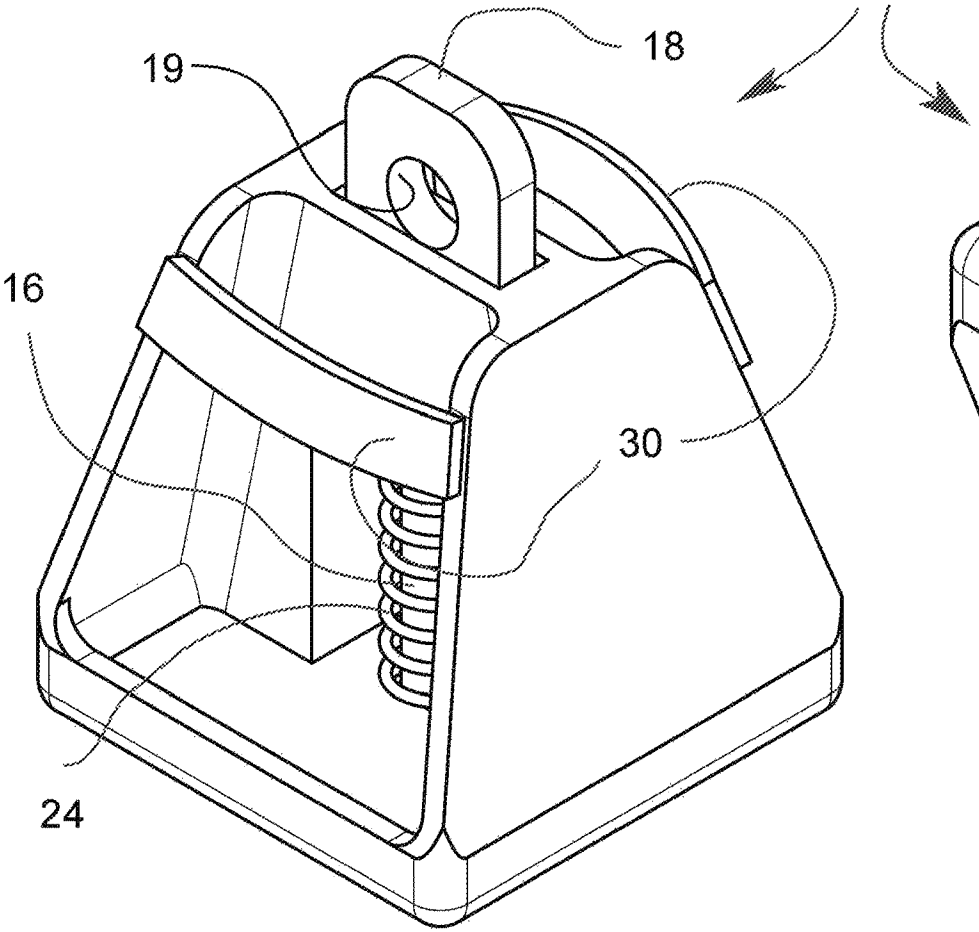

FIGS. 1A-B are isometric views of a tool 10 for lifting open floor gratings 12 according to an embodiment of the present invention. Referring now to FIGS. 1A-B, the tool is illustrated. In one embodiment, the tool comprises a body member 14 generally shaped as a pyramid having parallel bottom and top flat surfaces, the top flat surface having a first slot 21 configured to receive a push member 18 extending integrally from a shaft 16. The slot extends downwardly about halfway into the body member, and a second slot 23 is located at the bottom surface configured for receiving a butterfly hook 20 mechanically attached to a bottom portion of the shaft by way of mechanical fasteners 32. In one embodiment, the push member includes an opening 19 on its top end. The butterfly hook can be swapped so that different sizes and configurations of butterfly hooks can be swapped according to the configuration of the floor grating. In one embodiment, the push member is upwardly biased via biasing member 24, such as a coil. In one embodiment, a pair of cambered handle members 30 are provided for ease of transportation and installation.

Figures 2A, 2B:
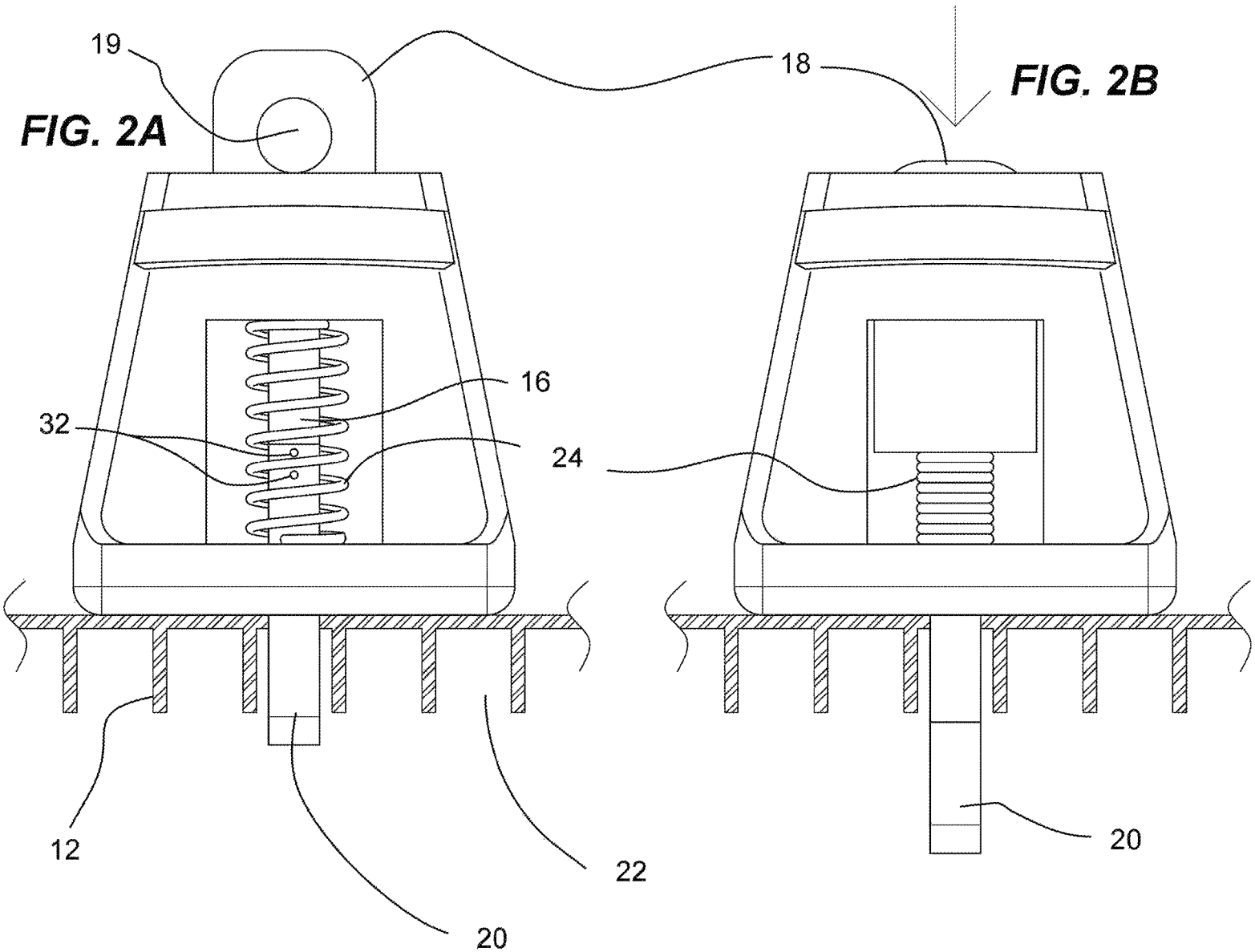
FIGS. 2A-B are side cutaway views of a push member of the tool in the upper and lower position respectively according to an embodiment of the present invention.

FIGS. 2A-B are side cutaway views of push member 18 of the tool in an upper and lower position respectively, according to an embodiment of the present invention. Referring now to FIG. 2A, the push member is shown in the upper position with biasing member 24 forcing the top of the push member and opening 19 out the slot and above the body member of the tool. In operation, the tool is positioned on an open floor grating 12, lining butterfly hook 20 between two bearing bars 22 as illustrated.

Referring now to FIG. 2B, the push member is forced downwardly, at a force exceeding the upwardly force of the biasing member such that the shaft and connecting butterfly hook extends under the floor grating as illustrated.

Figure 3A:
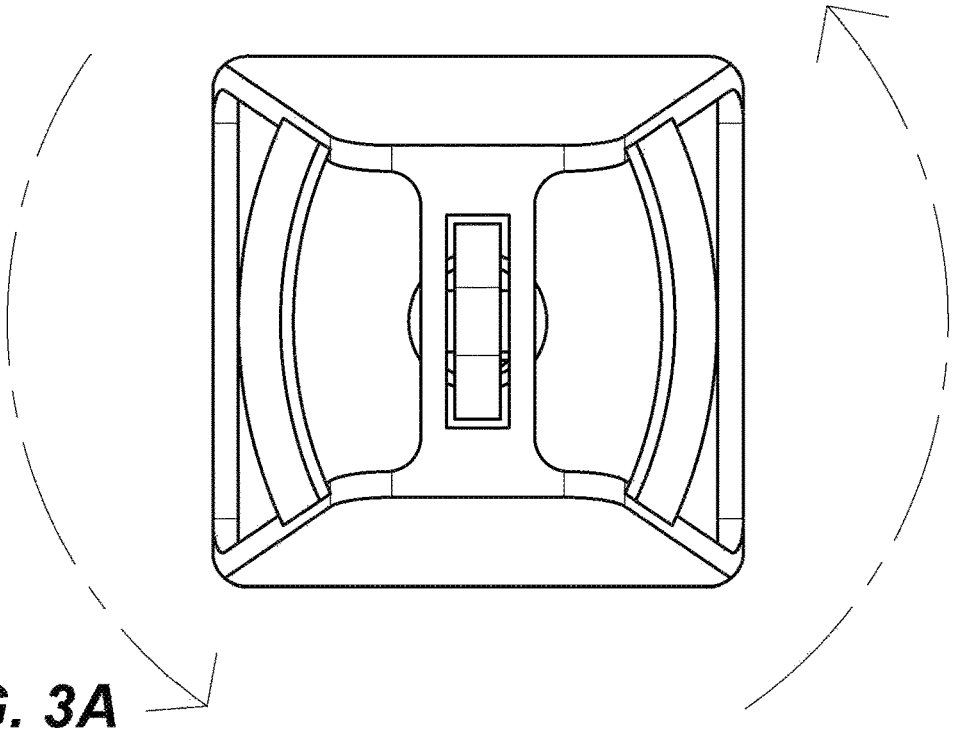
FIGS. 3A-B are top and side views of the tool on a floor grating according to an embodiment of the present invention; and, FIG. 4 is a side view of the tool with a shackle according to an embodiment of the present invention.
Figure 3B:
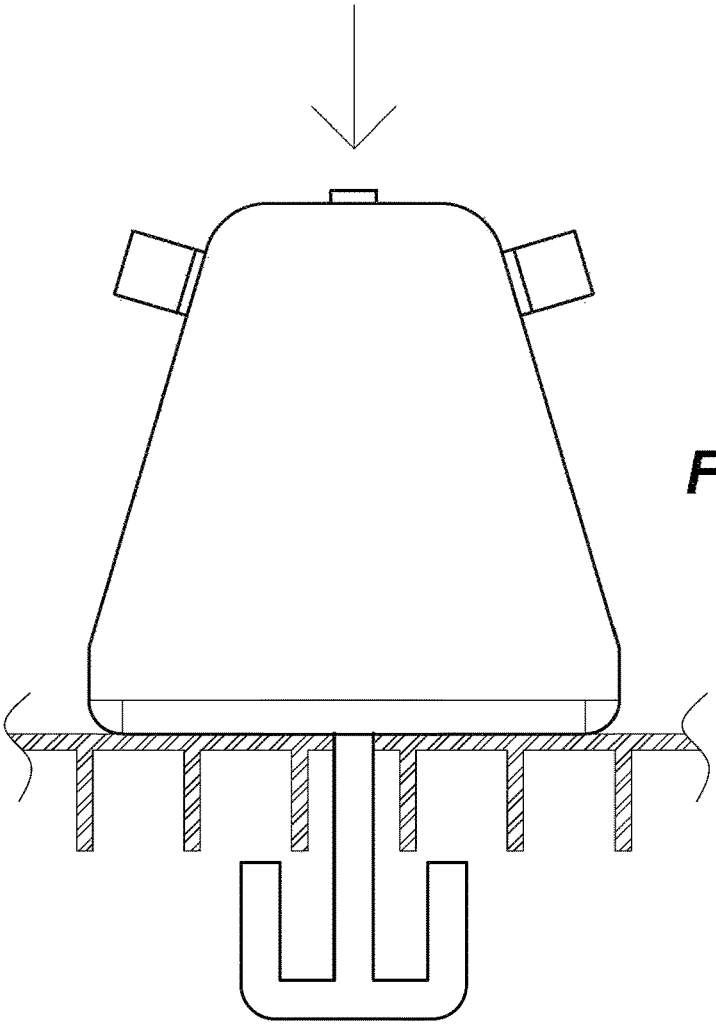

Referring now to FIGS. 3A-B, the operator then rotates the tool a quarter turn such that the butterfly hook can no longer pass through the bearing bars (best seen in FIG. 3B).

Figure 4:
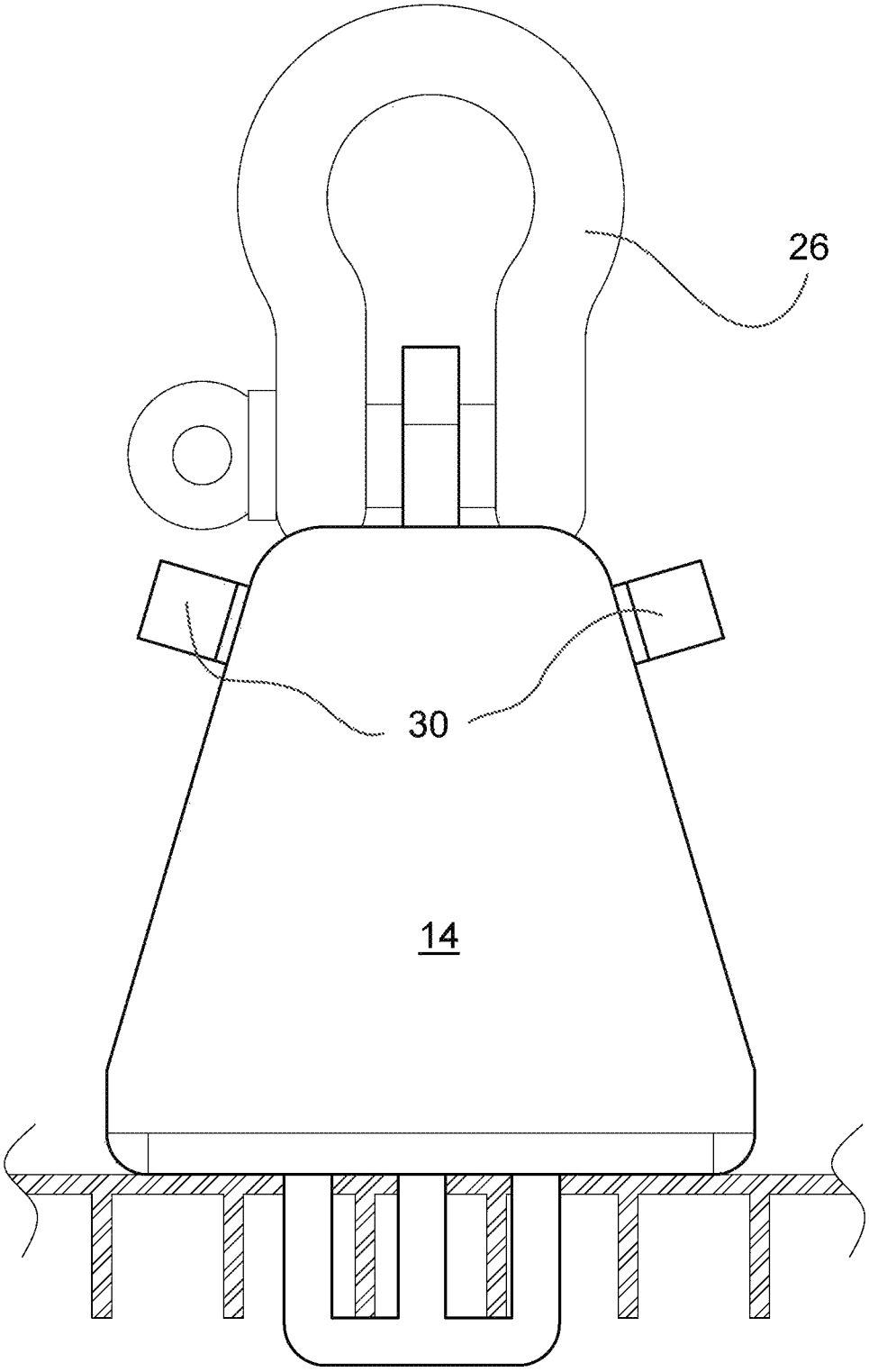

Referring now to FIG. 4, next, when the push member is released, the biasing member forces the push member back to its upper position such that the butterfly hook locks and hooks on the grating, completely enclosing the bearing bars. Once the bearing bars of the grating are hooked, a shackle 26 is installed through the opening. Finally, a steel cable (not shown) is hooked up with the shackle such that a crane may connect to the steel cable and hoist the tool and attached floor grating.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A tool for lifting a floor grating comprising:

a body member having a top surface and a bottom surface;

a first slot extending from the top surface to generally halfway into the body member, the first slot receiving a push member, wherein the push member has an opening at a top end of the push member, and wherein the push member extends integrally from an upper portion of a shaft, a second slot located at the bottom surface receiving a butterfly hook mechanically attached to a bottom portion of the shaft by way of mechanical fasteners; and a biasing member configured to upwardly bias the push member to an upper position;

wherein the tool is configured to be positioned on the floor grating, wherein the push member is configured to be pushed with a downward force overcoming the upwardly bias such that the butterfly hook extends below the floor grating, wherein the tool is configured to be rotated a quarter turn such that the butterfly hook may not pass through any bearing bars of the floor grating, and wherein the push member is configured to have the downward force released such that the push member is forced back to the upper position such that the butterfly hook locks and hooks on the floor grating.

2. The tool of claim 1, further comprising a pair of cambered handle members attached to the body member for ease of transportation and installation.

3. The tool of claim 1, further comprising a shackle installed through the opening such that a steel cable may be hooked to the shackle for hoisting the floor grating.

4. The tool of claim 1, wherein the body member is constructed to form a pyramid shape.

5. The tool of claim 4, wherein the top and bottom surfaces of the pyramid shape body member are parallel, flat surfaces.

6. The tool of claim 1, wherein the shaft allows for other butterfly hooks to be swapped by putting on or removing the mechanical fasteners and removing or installing the respective butterfly hook at the bottom portion of the shaft.

7. A method for lifting a floor grating comprising steps:

(a) providing a tool, the tool comprising:

a body member having a top surface, a bottom surface, and a slot extending from the top surface, the slot receiving a push member, wherein the push member has an opening at a top end of the push member, and wherein the push member is connected to a shaft, a butterfly hook at the bottom surface, wherein the shaft is connected to a top end of the butterfly hook, and a biasing member configured to upwardly bias the push member to an upper position;

(b) placing the tool on the floor grating in a first position defined as the butterfly hook parallel to bearing bars of the floor grating;

(c) applying a downward force to the push member overcoming the upwardly bias such that the butterfly hook extends below the floor grating and bearing bars;

(d) rotating the tool a quarter turn such that the butterfly hook may not pass through the bearing bars of the floor grating;

(e) releasing the downward force such that the push member is forced back to the upper positon such that the butterfly hook locks and hooks on the bearing bars of the floor grating;

(f) installing a shackle through the opening; and, (g) placing a steel cable through the shackle such that the tool may be hoisted with the attached floor grating via the steel cable.

8. The method for lifting a floor grating of claim 7, further comprising a step wherein the steel cable and attached floor grating are lifted via a crane.

* * * * *